US007852312B2

(12) United States Patent
Hong et al.

(10) Patent No.: US 7,852,312 B2
(45) Date of Patent: Dec. 14, 2010

(54) SYSTEM FOR CONTROLLING DRIVING LAMP OF BACKLIGHT UNIT

(75) Inventors: Hee Jung Hong, Seoul (KR); Hoon Jang, Gyeonggi-Do (KR)

(73) Assignee: LG Display Co., Ltd., Seoul (KR)

( * ) Notice: Subject to any disclaimer, the term of this patent is extended or adjusted under 35 U.S.C. 154(b) by 885 days.

(21) Appl. No.: 11/165,175

(22) Filed: Jun. 24, 2005

(65) Prior Publication Data

US 2006/0001642 A1 Jan. 5, 2006

(30) Foreign Application Priority Data

Jun. 30, 2004 (KR) ..... 10-2004-0050831

(51) Int. Cl.
*G09G 3/36* (2006.01)

(52) U.S. Cl. ..... 345/102; 345/212

(58) Field of Classification Search ..... 345/102, 345/211–213; 363/98

See application file for complete search history.

(56) References Cited

U.S. PATENT DOCUMENTS 7,352,352 B2 * 4/2008 Oh et al. ..... 345/102
2003/0038770 A1 * 2/2003 Lee et al. ..... 345/102
2004/0004596 A1 * 1/2004 Kang et al. ..... 345/102
2004/0051484 A1 3/2004 Moon
2005/0174818 A1 * 8/2005 Lin et al. ..... 363/98

FOREIGN PATENT DOCUMENTS

| | | |
|---|---|---|
| EP | 0141246 | 5/1985 |
| JP | 06-068979 | 3/1994 |
| JP | 2002-123226 | 4/2002 |
| TW | 535126 | 6/2003 |
| TW | 548617 | 8/2003 |

* cited by examiner

*Primary Examiner*—Chanh Nguyen
*Assistant Examiner*—Ram A Mistry
(74) *Attorney, Agent, or Firm*—McKenna Long & Aldridge LLP

(57) ABSTRACT

A liquid crystal display device including a liquid crystal display panel, a lamp for emitting light to the a liquid crystal display panel, a timing controller for generating a lamp control signal to control a light-on time of the lamp, and an inverter for controlling a light-on and a light-off of the lamp according to the lamp control signal while limiting current and maintaining power supplied to the lamp regardless of the light-on time for the lamp.

9 Claims, 4 Drawing Sheets

SYSTEM FOR CONTROLLING DRIVING LAMP OF BACKLIGHT UNIT

This application claims the benefit of Korean Patent Application No. 10-2004-0050831, filed in Korea on Jun. 30, 2004, which is hereby incorporated by reference in its entirety.

BACKGROUND OF THE INVENTION

1. Field of the Invention

The present invention relates to a display device, and particularly, to a system for controlling driving lamp of backlight unit.

2. Description of the Related Art

Recently, display devices have been becoming more important as an information transfer media in the growing information society. Among those display devices, the liquid crystal display device has been rapidly replacing a cathode ray tube (CRT) as a next generation of display device. The liquid crystal display device has superior visibility, lower power consumption, and a clearer image quality.

In general, a liquid crystal display device includes a liquid crystal display panel having a thin film transistor array substrate attached to a color filter substrate with a uniform cell-gap therebetween and liquid crystal molecules in the uniform cell-gap, a driving unit for driving the liquid crystal display panel, and a back-light unit for supplying light to the liquid crystal display panel. Because the liquid crystal display device does not emit light by itself, a separate light source, such as a backlight unit, is installed at a rear surface of the liquid crystal display panel. A plurality of gate lines and data lines perpendicularly cross each other in the liquid crystal display panel to define pixels that are arranged in a matrix form. The light supplied from the separate light source is controlled by each of the pixels to produce an image.

A back-light unit includes a lamp for emitting light in response to receiving power; an inverter for adjusting an amount of light emitted from the lamp by controlling current of the power supplied to the lamp, and an optical member for uniformly distributing the light across the entire surface of the liquid crystal display panel by condensing and diffusing the light of the lamp. The back-light unit can be an edge-type having the lamp provided at a side surface of the liquid crystal display panel or an orthogonal-type having a plurality of lamps arranged at a rear surface of the liquid crystal display panel. The use of these types of backlights depends on the dimension of the liquid crystal display panel. For example, in a large liquid crystal display panel, the orthogonal-type is generally used such that a plurality of lamps are arranged at the rear surface of the entire surface of the liquid crystal display panel to provide high brightness, thereby supplying a large amount of light to the liquid crystal display panel.

FIG. 1 is a block diagram illustrating the related art liquid crystal display device. Referring to FIG. 1, a liquid crystal display device includes a timing controller 2 for generating a plurality of control signals in response to receiving image data DATA, a liquid crystal display panel 1 in which a plurality of data lines D1 to Dm and gate lines G1 to Gn cross each other, a data driving unit 4 for supplying image information to the liquid crystal display panel 1 in response to control signals from the timing controller 2, a gate driving unit 6 for applying a scanning signal to the liquid crystal display panel 1 in response to control signals from the timing controller 2, and an inverter 8 for controlling power to the lamp 10 in response to a control signal from the timing controller 2.

The timing controller 2 receives the image data DATA from an exterior graphic system, such as a graphic card, to generate a plurality of control signals for controlling the data driving unit 4 and the gate driving unit 6 using a basic control signal and image information included in the image data DATA. Afterwards, the timing controller 2 supplies the generated control signals to the corresponding data driving unit 4 and the gate driving unit 6. The timing controller 2 also supplies control signals to both the data driving unit 4 and the gate driving unit 6 to regulate driving timing.

In the liquid crystal display panel, gate lines G1 to Gn and data lines D1 to Dm cross each other to define a plurality of pixels arranged in a matrix configuration. The pixels are electrically connected to the data lines D1 to Dm in response to signals on the gate lines G1 to Gn. Accordingly, the pixels are driven in lines with image information of the data driving unit 4 transferred through the data lines D1 to Dm and a scanning signal of the gate driving unit 6 transferred through the gate lines G1 to Gn. The inverter 8 converts direct current power applied from the exterior into a high voltage that is supplied to the lamp 10. The inverter 8 also adjusts the amount of light from the lamp 10 by controlling the amount of current in response to a lamp control signal DCS1, which is applied from the timing controller 2.

An orthogonal-type backlight unit in which a plurality of lamps are typically arranged at a rear surface of the liquid crystal display panel 1 at a certain interval is generally used as the lamp 10. The orthogonal-type can advantageously provide images of high brightness by uniformly supplying a large amount of light across the entire surface of the liquid crystal display panel 1. However, by using the orthogonal-type back-light unit, the wider the liquid crystal display panel is, the more the number of lamps increases. As a result, power consumption proportional increases in as much as the number of lamps increases. Accordingly, research has been carried out with respect to methods for reducing power consumed in an orthogonal-type back-light unit.

A scanning driving method has been proposed to reduce power consumption. In the scanning driving method, not all of the lamps of a backlight unit are turned on. Only a certain number of lamps are turned on to display an image. According to this method, power consumption can be reduced by controlling the number of lamps that are simultaneously turned on.

FIG. 2 is an exemplary view illustrating lamps which are turned on and off according to the related art scanning driving method. Referring to FIG. 2, a driving frequency is 60 Hz, which is usually used, and accordingly one frame is 16.7 ms. The liquid crystal display panel 1 has eight lamps in a back-light unit. In FIG. 2, a white lamp indicates a light-on lamp and a black lamp indicates a light-off lamp.

A scanning signal is sequentially applied from the gate driving unit to the plurality of gate lines arranged in a horizontal direction on the liquid crystal display panel 1. Therefore, pixels arranged in a matrix configuration on the liquid crystal display panel 1 sequentially display images by lines corresponding to the gate lines. The lamps 10 arranged in the same direction as the gate lines turn on in correspondence with the plurality of gate lines, respectively. That is, the scanning signal is sequentially applied to the plurality of gate lines. While the pixels display images by a line, the lamps 10 corresponding to each position of the gate lines maintain their on-state. Thus, light is supplied to corresponding pixels in a line with lighting (turning on) of the lamps 10 sequentially one by one from an upper region of the liquid crystal display panel 1.

In the scanning driving method, since there is a maximum predetermined number of lamps to be turned on, after completely turning on the lamps in as many as the maximum predetermined number, when a new lamp 10 is turned on, the lamp 10 which had first been previously lit up is turned off so as to uniformly maintain the maximum predetermined number of light-on lamps 10. That is, as illustrated in FIG. 2, the lamps are turned on sequentially from a first lamp 10 until a maximum predetermine number of five lamps 10, for example, are turned on in a first frame. When a sixth lamp 10 is turned on, the first lamp 10 which had been first turned on is turned off. Thus, only five lamps 10 are in a light-on state, and the positions of where the lamps are turned on are shifted one by one. As a result, when the last lamp is turned on, the first frame is completed. In a second frame, the maximum predetermine number of five lamps 10, for example, are in their light-on state, and in the last light-on state of the lamps 10 in the first frame, the light-on position of the lamps 10 in the second frame is shifted as many as one lamp 10. That is, the first lamp 10 is turned on again, and the fifth to eighth lamps 10 maintain their light-on state.

FIG. 2 illustrates driving the lamps 10 during one frame. Here, a time for maintaining a light-on state of a specific lamp 10 with respect to one frame is referred to as a scanning duty, namely, a light-on time/frame of the specific lamp 10. For instance, the first lamp 10 maintains its light-on state until the fifth lamp 10 is turned on, but is turned off when the sixth lamp 10 is turned on. At this time, the first lamp 10 maintains its light-on state during 2.09 ms×5 of one frame (16.7 ms). In other words, five eighths of one frame is the scanning duty.

According to the scanning driving method, although each lamp 10 is turned on depending on the scanning duty, the maximum predetermine number of five lamps 10, for example, have a light-on state during each 2.09 ms, a unit section of one frame. Therefore, power consumption of the lamps 10 can be reduced and images can still somewhat be provided. However, compared with the related art method in which the lamps are continuously turned on during one frame, brightness of the images is less than when using the scanning driving method. Current applied to the lamps 10 is controlled by an inverter. In the lamp scanning method shown in FIG. 2, the inverter controls the current applied to each lamp according to the scanning duty, thereby adjusting an amount of light from all of the lamps.

FIG. 3 is an exemplary view illustrating the related art waveform of a current applied to each lamp according to the scanning duty. As illustrated in FIG. 3, an alternating current with a certain level is supplied to lamps during a predetermined scanning duty. That is, an inverter controls the current amount supplied to each lamp in every frame according to the scanning duty. However, because the amplitude of the current supplied to each lamp is fixed, scanning duty has to be reduced to reduce power consumption of the lamps. In other words, the time for supplying the current to each lamp is reduced, which results in a reduced amount of power being supplied to the lamp. As a result, brightness of the lamp may also be reduced. Thus, an average brightness can be changed due to a variation in the scanning duty, which results in a degradation of image quality in a liquid crystal display device.

When amplitude of the current is fixed at a high value to prevent a degradation of brightness of the lamp due to variation in the scanning duty, a large amount of power is supplied to the lamps. A large amount of power can cause a lack of uniformity of mercury densities within a lamp. Thus, a non-niformity of brightness may occur or an error in light color emitted from the lamp may occur, such as pink discharge. Therefore, reliability of the lamp may be lowered.

SUMMARY OF THE INVENTION

Accordingly, the present invention is directed to a system for controlling driving lamp of backlight unit that substantially obviates one or more of the problems due to limitations and disadvantages of the related art.

An object of the present invention is to provide a system for controlling driving lamp of backlight unit is that can improve reliability of lamps in a backlight unit.

Another object of the present invention is to provide a system for controlling driving lamp of backlight unit that can reduce aging in the lamps of a backlight unit.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described herein, there is provided a liquid crystal display device including a liquid crystal display panel, a lamp for emitting light to the a liquid crystal display panel; a timing controller for generating a lamp control signal to control a light-on time of the lamp, and an inverter for controlling a light-on and a light-off of the lamp according to the lamp control signal while limiting current and maintaining power supplied to the lamp regardless of the light-on time for the lamp.

In another aspect, a liquid crystal display device includes a liquid crystal display panel, a lamp for emitting light to the a liquid crystal display panel, a timing controller for outputting a lamp control signal, an oscillator for generating an alternating current by conducting and blocking with first set of switching devices and a second set of switching devices, a lamp controller for providing switching signals to the first and second sets of switching devices, monitoring the power of the oscillator and adjusting a conducting time of the first set of switching devices and the second set of switching devices according to a difference between the monitored power and a reference power, a transformer for converting the alternating current generated from the oscillator into high voltage that is applied to the lamp, and a comparing unit for limiting the current of the lamp.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
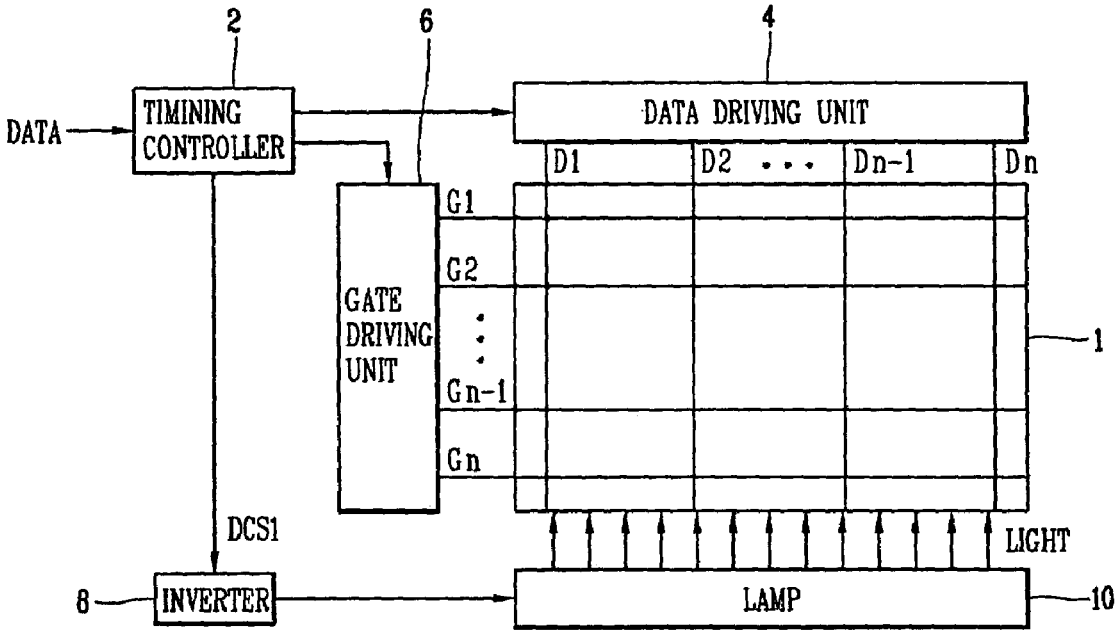
FIG. 1 RELATED ART
FIG. 1 is a block diagram illustrating the related art liquid crystal display device.
Figure 2:
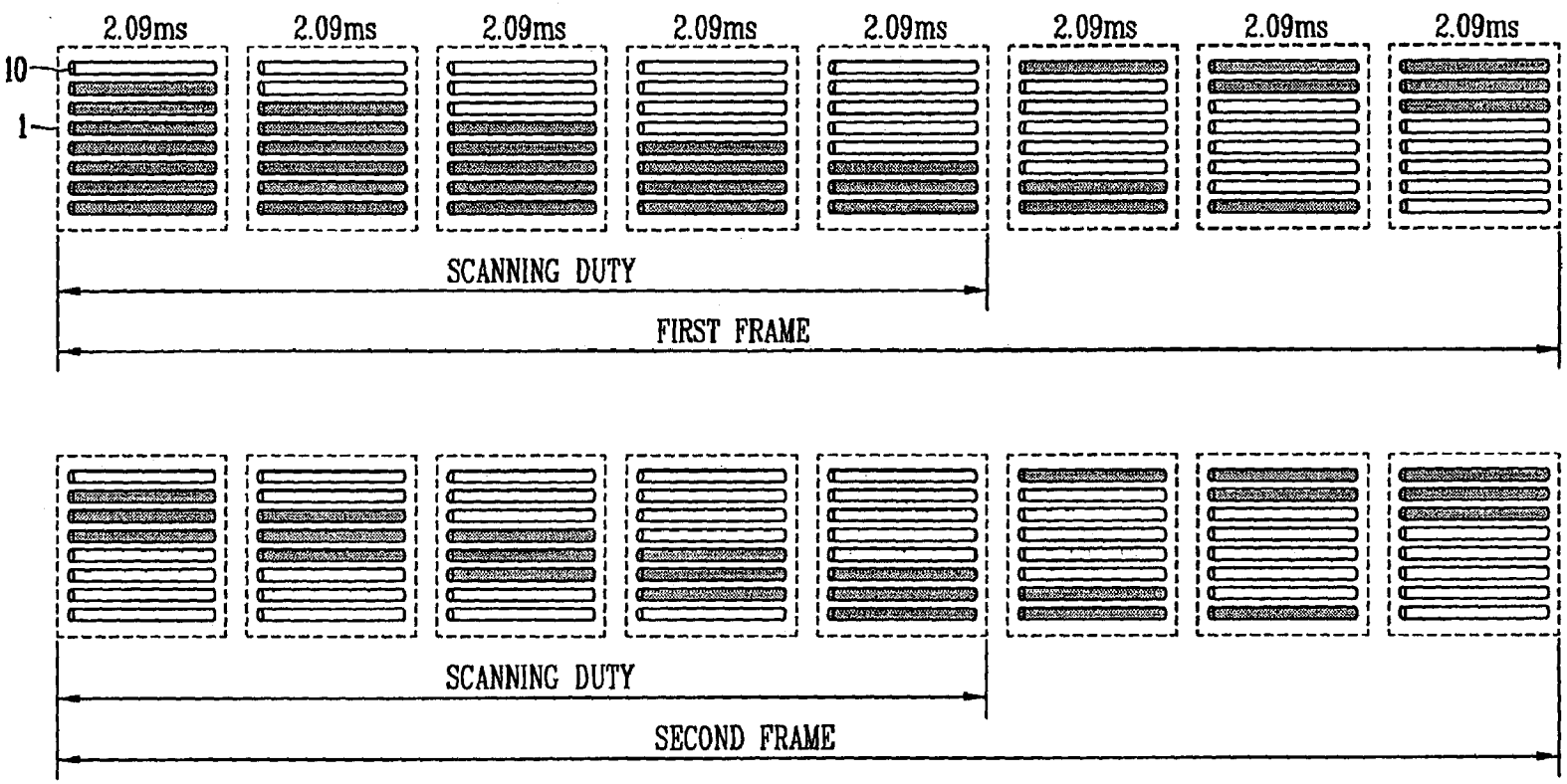
FIG. 2 RELATED ART
FIG. 2 is an exemplary view illustrating a lamp turned off according to the related art scanning driving method.
Figure 3:
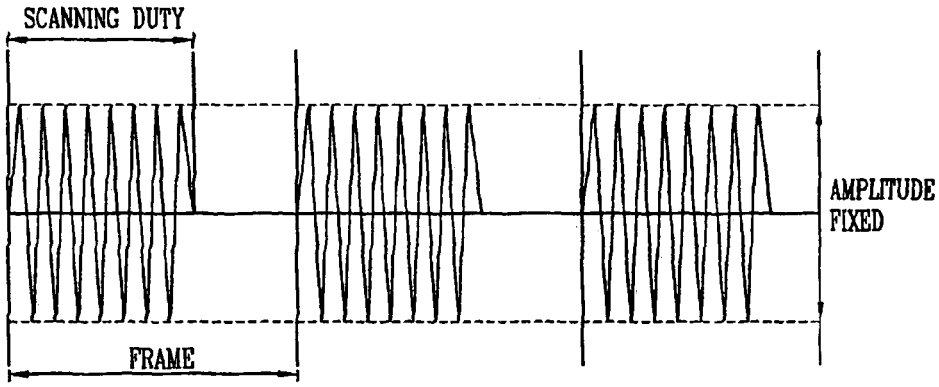
FIG. 3 RELATED ART
FIG. 3 is an exemplary view illustrating the related art waveform of a current supplied to a lamp according to a scanning duty.
Figure 4:
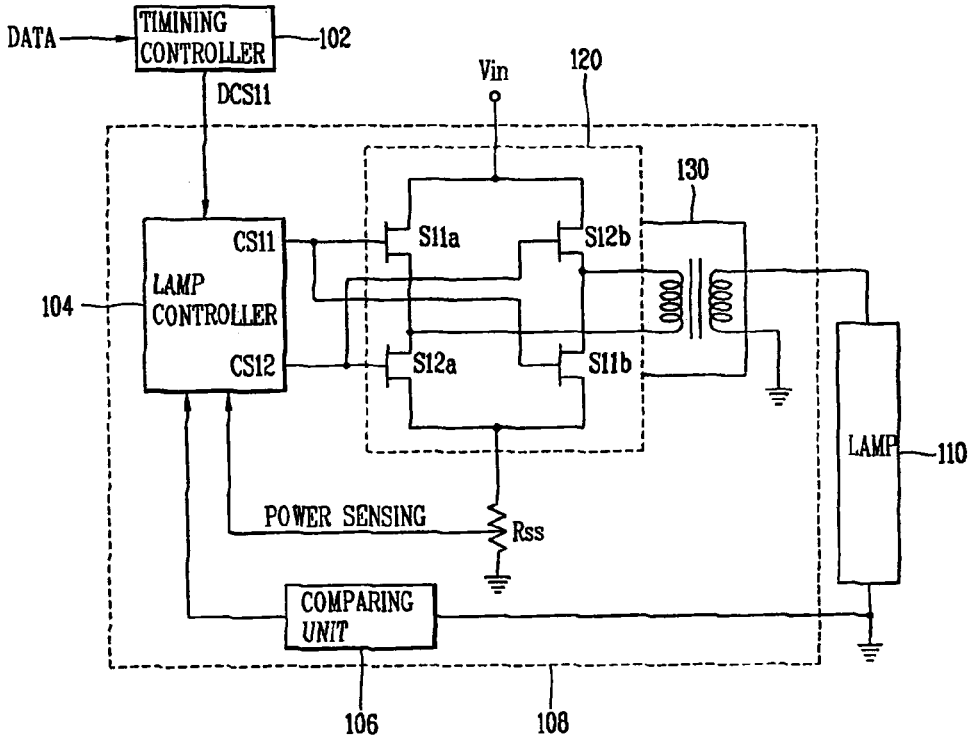
FIG. 4 illustrates a liquid crystal display device according to an embodiment of the present invention.

A liquid crystal display device according to an embodiment of the present invention includes a lamp for emitting light, a timing controller for generating a lamp control signal to control a light-on time of the lamp, and an inverter for controlling a light-on and light-off of the lamp according to the lamp control signal, maintaining the power supplied to the lamp regardless of the light-on time thereof, and controlling the current of the lamp to be under a predetermined value. FIG. 4 illustrates a back-light unit of a liquid crystal display device according to an embodiment of the present invention. Although the entire liquid crystal display device is not shown in FIG. 4, the liquid crystal display device according to an embodiment of the present invention includes a liquid crystal display panel in which two substrates facing each other are attached with a cell-gap therebetween, liquid crystal molecules in the cell-gap between the two substrates, a driving unit for driving the liquid crystal display panel with various control signals and a driving voltage to the liquid crystal display panel, and a back-light unit for supplying light to the liquid crystal display panel. As shown in FIG. 4, a timing controller 102 of the driving unit generates various control signals in response to external data DATA. The various control signals control the liquid crystal display panel and the amount of light from the back-light unit.

The back-light unit includes lamps 110 for supplying light to the liquid crystal display panel, a lamp controller 104 for generating a lamp control signals CS11 and CD12 in response a control signal DCS11 from the timing controller 102, and an inverter 108 for converting a direct current power Vin into a high voltage alternating current to supply it to the lamps 110, and controlling a driving of the lamps 110 according to the lamp control signal DCS11 of the timing controller 102. The inverter 108 includes an oscillator 120 for generating an alternating current from a direct current power Vin supply, a transformer 130 for converting the alternating current generated from the oscillator 120 into a high voltage that is supplied to the lamps 110, and a lamp controller 104 for carrying out an on/off control for the lamps 110 by controlling the oscillator 120 according to the lamp control signal DCS11 of the timing controller 102 and maintaining power applied to the lamps 110 at a uniform level. The oscillator 120 includes a plurality of switching devices S11 and S12, such as thin film transistors, for controlling flow of alternating current Vin, and is electrically connected to the lamp controller 102.

The timing controller 102 generates a plurality of control signals upon receipt of external data DATA. The plurality of control signals include an image signal supplied to the liquid crystal display panel and a lamp control signal DCS11 supplied to the back-light unit. To control the lamps 110 according to images to be displayed on the liquid crystal display panel, the timing controller 102 applies the lamp control signal DCS11 to the back-light unit, and accordingly controls the lamps 110 through the inverter 108 of the back-light unit.

A direct-type backlight unit in which a plurality of lamps 110 are arranged at a rear surface of a liquid crystal display panel supplies a large amount of light to the liquid crystal display panel. To reduce a great amount of power consumption, which is a typical shortcoming the direct-type backlight unit, the lamps 110 are driven by the scanning method. It is important in the scanning method to precisely adjust an on/off timing of each lamp 110. The inverter 108 precisely turns on each lamp 110 corresponding to a scanning duty in accordance with a lamp control signal DCS11 supplied to the timing controller 102.

The lamp controller 104 receives the lamp control signal DCS11 applied from the timing controller 102 and controls the oscillator 120 according to the lamp control signal DCS11. The oscillator 120, as shown in FIG. 4, is a full-bridge circuit including four switching devices S11*a*, S11*b*, S12*a* and S12*b*. However, the oscillator 120 is not limited only to the full-bridge circuit. A first control signal CS11 and a second control signal CS12 generated from the lamp controller 104 are signals having the same frequency in a reverse pulse arrangement to each other. The frequency therefore may generally correspond to about 60~65 kHz. Since the first and second control signals CS11 and CS12 have reverse pulse arrangements with respect to each other, the first set of switching devices S11*a* and S11*b* and the second set of switching devices S12*a* and S12*b* are alternately turned on or off.

A direct current power Vin is input into one side of the oscillator 120 and accordingly a current flow is changed by the first and second sets of switching devices S11*a*, S11*b*, S12*a* and S12*b*, which are turned on or off by the first and second control signals CS11 and CS12. That is, the oscillator 120 converts the direct current power Vin into an alternating current with the first and second sets of switching devices S11*a*, S11*b*, S12*a* and S12*b*. The alternating current is supplied to the transformer 130. The transformer 130 converts the alternating current to a high voltage for supply to the lamp 110. The lamp 110 starts up due to the high voltage and emits light.

The lamp 110 continuously emits light to the liquid crystal display panel while the alternating current is supplied to from the oscillator 120. However, when the alternating current supply is stopped by turning off all of the switching devices S11*a*, S11*b*, S12*a* and S12*b* of the oscillator 120, the lamp 110 is also turned off. This on/off time of the lamp 110 is determined by a scanning duty included in the lamp control signal DCS11, which is supplied from the timing controller 102 to the lamp controller 104. Since the scanning duty included in the lamp control signal DCS11 determines the on/off time of the lamp 110, the lamp controller 104 supplies the first and second control signals CS11 and CS12 to the oscillator 120 only during the scanning duty to operate the first and second sets of switching devices S11*a*, S11*b*, S12*a* and S12*b*. When a time corresponding to the scanning duty is completed, the first and second control signals CS11 and CS12 are not supplied any more and accordingly both the first and second sets of switching devices S11*a*, S11*b*, S12*a* and S12*b* are turned off. Therefore, the oscillator 120 does not generate the alternating current any more and the high voltage is not supplied to the lamp 110 any more.

The first and second sets of switching devices S11*a*, S11*b*, S12*a* and S12*b* of the oscillator 120 are commonly connected to a sensing resistance Rss. A ground is connected to one side of the sensing resistance Rss. The sensing resistance Rss is equipped for feedback sensing of power applied to the oscillator 120. Alternating current is generated and flows through the oscillator 120 while the first and second control signals CS11 and CS12 are supplied from the lamp controller 104. At this time, the lamp controller 104 senses the power supplied by the oscillator 120 and compares the sensed power to a reference power so as to control the oscillator 120.

That is, while the current flows in the oscillator 120, a voltage is sensed at both ends of the sensing resistance Rss which is thereafter feedbacked to the lamp controller 104. Further, the lamp controller 104 compares a reference voltage stored therein with the voltage sensed through the sensing resistance Rss, thereby recognizing the power being generated by the oscillator 120. If the power of the oscillator 120 is lower than the reference power, the lamp controller 104 allows the power of the oscillator 120 to be maintained as a reference power level using a method for increasing an amplitude of the alternating current generated from the oscillator 120.

As aforementioned, in the related art, when the scanning duty is shortened, the current supplied to the oscillator 120 has been reduced and accordingly the power has also been reduced. Therefore, power changes according to the scanning duty. However, in embodiments of the present invention, since the power is identically maintained during the on/off time of the lamps 110 regardless of the scanning duty, which restricts the on/off time of the lamps 110, brightness of the lamps 110 is prevented from being degraded. A reference power can appropriately be established such that brightness of images can be realized at a desired level. In addition, the reference power supplied to the oscillator 120 is uniformly maintained by the lamp controller 104 regardless of the scanning duty.

The lamp controller 104 for uniformly maintaining the reference power is operated as follows. When the power of the oscillator 120 detected by the sensing resistance Rss to be lower than the reference power, the lamp controller 104 adjusts a timing for supplying the first and second control signals CS11 and CS12 to the oscillator 120, so as to lengthen a time for maintaining a turned-on state of the first and second sets of switching devices S11*a*, S11*b*, S12*a* and S12*b*. In other words, by adjusting a time from a turned-on time of the first set of switching devices S11*a* and S11*b* to a turned-off time thereof, the amplitude of the current flowing in the oscillator 120 is adjusted by the first switching devices S11*a* and S11*b*. In addition, by adjusting a time from a turned-on time of the second switching devices S12*a* and S12*b* to a turned-off time thereof, the amplitude of the current flowing in the oscillator 120 is adjusted by the second set of switching devices S12*a* and S12*b*. Thus, the power of the oscillator 120 can maintain the reference power level regardless of the scanning duty by adjusting the amplitude of the current of the oscillator 120. The lamp controller 104 compares the power of the oscillator 120 with the reference power to establish a reference voltage so as to maintain the reference power.

The reference voltage is continuously established into different values according to the change of the power of the oscillator 120, thereby varying the amplitude of the current of the oscillator 120. Thus, the lamp controller 104 adjusts a light-on time of the lamps 110 according to the scanning duty supplied from the timing controller 102, and also adjusts the amplitude of the current by lengthening a conducting time of the sets of switching devices S11*a*, S11*b*, S12*a* and S12*b* according to a decrease of power in the oscillator 120 to prevent brightness of the lamps 110 from being changed due to a change in the scanning duty. As a result, the power of the oscillator 120 can uniformly be maintained. That is, in embodiments of the present invention, the lamp controller 104 compensates for a loss of power due to the scanning duty by changing the amplitude of the current in the oscillator 120.

On the other hand, although the lamps 110 provided in the liquid crystal display device are different from one another according to models thereof, a maximum permissible current value can be set that ensures reliability and long life expectancy of the lamps 110. When a current more than the maximum permissible current value is applied to the lamps 110, the lamps 110 are irregularly aged and shorten the lives of the lamps. Therefore, although the amplitude of the current is adjusted to uniformly maintain power of the backlight unit, the current applied to the lamp 110 should be adjusted not to exceed the maximum permissible current.

A comparing unit 106 is provided at an output terminal of the lamps 110 for performing current limiting. The comparing unit 106 is connected between one side of the lamp 110 and the lamp controller 104 so as to detect a current. When the detected current exceeds the pre-established maximum permissible current of the lamps 110, the comparing unit 106 applies a signal to the lamp controller 104. The lamp controller 104 adjusts an output timing of the first and second control signals CS11 and CS12 according to the signal from the comparing unit 106, and accordingly clamps the amplitude of the current flowing in the oscillator 120. That is, the current of the oscillator 120 is limited. Although not shown in FIG. 4, the comparing unit 106 may be included in the lamp controller 104, and accordingly the lamp controller 104 can also perform the current limiting.

The reference power can be established differently according to a user's usage in a liquid crystal display device according to embodiments of the present invention. In the case of desiring an image with high brightness, a higher reference power is established, while a low reference power is established in case of desiring an image with a lower brightness.

In case of displaying a screen including many moving pictures, when the scanning duty is great, a blur phenomenon occurs in which ghost of an image keeps appearing. In order to reduce this blur phenomenon, the scanning duty can be adjusted by the timing controller 102. Therefore, when the scanning duty supplied from the timing controller 102 to the lamp controller 104 is reduced, the light-on time of the lamps 110 is shortened, which results in a reduction of the blur phenomenon.

Figure 5:
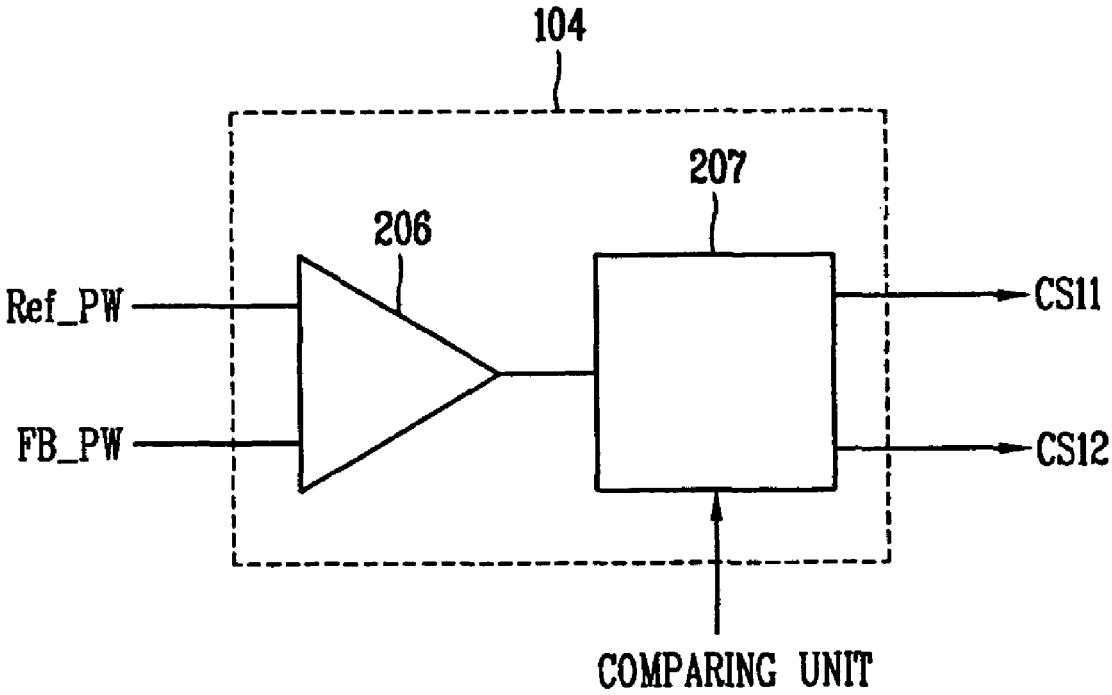
FIG. 5 is an exemplary view illustrating the lamp controller.

FIG. 5 is an exemplary view illustrating the lamp controller.

As shown in FIG. 5, the lamp controller 104 includes a comparing stage 206 for comparing a reference power Ref_PW with a feedback power FB_PW sensed from the oscillator 120 and thus outputting the result of the comparison, and a control stage 207 for receiving the result obtained from the comparing stage 206 and outputting the first and second control signals CS11 and CS12 according to a signal from the comparing unit 106.

The comparing stage 206 receives the reference power Ref_PW applied from the timing controller 102 and compares it with the feedback power FB_PW sensed from the oscillator 120. The result from the comparison is sent to the control stage 207. The control stage 207 adjusts an output timing of each of the first and second control signals CS11 and CS12 so as to uniformly maintain the reference power Ref_PW according to the difference value between the reference power Ref_PW and the feedback power FB_PW. At this time, when the output current of the lamp 110 exceeds a predetermined maximum value and accordingly the comparing unit 106 applies a signal to the lamp controller 104, the output timing of each of the first and second control signals CS11 and CS12 is eventually controlled and the first and second control signals CS11 and CS12 are then outputted. As a result, the size of the current of the oscillator 120 can be limited.

As described above, in the liquid crystal display device according to the present invention, regardless of the scanning duty of the lamp, an image which has desired brightness can be realized by uniformly maintaining power of the backlight unit. Furthermore, although the amplitude of the current is increased in order to prevent a change of brightness of the lamp due to the scanning duty, a maximum current size is established so as to prevent a current which exceeds the permissible value of the lamp from being applied to the lamp. As a result, reliability of the lamp can be increase.

It will be apparent to those skilled in the art that various modifications and variations can be made in the liquid crystal display device of the present invention without departing from the spirit or scope of the invention. Thus, it is intended that the present invention cover the modifications and variations of this invention provided they come within the scope of the appended claims and their equivalents.

What is claimed is:

1. A system for controlling a driving lamp of a backlight unit comprising:

a liquid crystal display panel;

a lamp for emitting light to the liquid crystal display panel;

a timing controller for generating a lamp control signal to control a light-on time of the lamp; and an inverter for controlling a light-on and a light-off of the lamp according to the lamp control signal while limiting current and maintaining a constant wattage of the power supplied to the lamp regardless of the light-on time for the lamp, wherein the inverter is provided with a comparing unit for supplying a signal to a lamp controller when the current of the lamp exceeds an established value, and wherein the inverter includes:

an oscillator for generating an alternating current, wherein the oscillator includes: a plurality of first switching devices that conduct or block in accordance with a first control signal; a plurality of second switching devices that conduct or block in accordance with a second control signal; and a sensing resistance for detecting power of the oscillator, wherein the first and second pluralities of switching devices are alternately conducting or blocking in accordance with the first and second control signals;

a lamp controller for controlling the generation of the alternating current in the oscillator during an established time in accordance with the lamp control signal of the timing controller, and adjusting power applied to the oscillator in accordance with a reference power level, wherein the lamp controller alternately outputs a first control signal and a second control signal to control the generation of current in the oscillator, and wherein the lamp controller compares the detected power with a reference power, and establish a reference voltage according to a difference therebetween so that the lamp controller increases the reference voltage when the power of the oscillator is lower than the reference power, and wherein the lamp is turned on while the first and second control signals are supplied from the lamp controller to the oscillator in each frame, and wherein the lamp controller adjusts a conducting time of the first and second switching devices of the oscillator by the first and second control signals, to adjust an amplitude of the current generated by the oscillator from the reference voltage; and a transformer for converting the alternating current generated from the oscillator to a high voltage that is supplied to the lamp.

2. The system of claim 1, wherein the oscillator is a full-bridge circuit including four switching devices.

3. The system of claim 1, wherein the first and second switching devices are thin film transistors.

4. The system of claim 1, wherein the first and second control signals are pulse type signals.

5. The system of claim 4, wherein the first and second control signals have a frequency of 60 to 65 kHz.

6. The system of claim 4, wherein the second control signal is a pulse signal that is a reverse of the first control signal.

7. The system of claim 1, wherein the established value is a maximum permissible current of the lamp.

8. The system of claim 1, wherein the comparing unit is included in the lamp controller.

9. A system for controlling a driving lamp of a backlight unit comprising:

a liquid crystal display panel;

a lamp for emitting light to the liquid crystal display panel;

a timing controller for outputting a lamp control signal, wherein the timing controller generates the lamp control signal to control a light-on time of the lamp;

an inverter for controlling a light-on and a light-off of the lamp according to the lamp control signal while limiting current and maintaining a constant wattage of the power supplied to the lamp regardless of the light-on time for the lamp, wherein the inverter includes:

an oscillator for generating an alternating current by conducting and blocking with a first set of switching devices and a second set of switching devices, wherein an amplitude of an alternating current generated from the oscillator is determined according to a reference voltage;

a lamp controller for providing switching signals to the first and second sets of switching devices, monitoring the power of the oscillator and adjusting a conducting time of the first set of switching devices and the second set of switching devices according to a difference between the monitored power and a reference power, wherein the lamp controller clamps the amplitude of the current generated by adjusting a conducting time of the first and second switching devices of the oscillator according to a signal from a comparing unit, wherein the lamp controller compares the detected power with a reference power, and establish a reference voltage according to a difference therebetween so that the lamp controller increases the reference voltage when the power of the oscillator is lower than the reference power, and the lamp is turned on while the first and second control signals are supplied from the lamp controller to the oscillator in each frame, and wherein the lamp controller adjusts a conducting time of the first and second switching devices of the oscillator by the first and second control signals, to adjust an amplitude of the current generated by the oscillator from the reference voltage; and a transformer for converting the alternating current generated from the oscillator into high voltage that is applied to the lamp, wherein the comparing unit limits the current of the lamp, and wherein the comparing unit monitors the current of the lamp and outputs a signal to the lamp controller when the monitored current is higher than a predetermined maximum value, wherein the comparing unit is included in the lamp controller.

* * * * *